US007485787B2

(12) United States Patent
McMichen, III

(10) Patent No.: US 7,485,787 B2
(45) Date of Patent: Feb. 3, 2009

(54) MUSICAL INSTRUMENT

(75) Inventor: Bernist Leon McMichen, III, Nashville, TN (US)

(73) Assignee: Roland Meinl Musikinstrumente GmbH & Co. KG, Neustadt/Aisch (DE)

( * ) Notice: Subject to any disclaimer, the term of this patent is extended or adjusted under 35 U.S.C. 154(b) by 0 days.

(21) Appl. No.: 11/709,776

(22) Filed: Feb. 23, 2007

(65) Prior Publication Data

US 2008/0202315 A1 Aug. 28, 2008

(51) Int. Cl.
*G10D 13/06* (2006.01)

(52) U.S. Cl. ..... 84/402

(58) Field of Classification Search ..... 84/402
See application file for complete search history.

(56) References Cited

U.S. PATENT DOCUMENTS

| | | | | | |
|---|---|---|---|---|---|
| 471,046 | A | * | 3/1892 | Wilskey | 446/421 |
| 1,334,631 | A | * | 3/1920 | Piazza | 84/270 |
| 1,495,672 | A | * | 5/1924 | Cheney | 84/411 R |
| 1,858,171 | A | * | 5/1932 | Providenti | 84/271 |
| 2,031,706 | A | * | 2/1936 | Hambrecht et al. | 84/294 |
| 2,033,826 | A | * | 3/1936 | Haium | 84/173 |
| 2,523,963 | A | * | 9/1950 | Mitchell | 84/267 |
| 2,645,970 | A | * | 7/1953 | Stabile | 84/403 |
| 2,807,182 | A | * | 9/1957 | Briggs | 84/400 |
| 3,240,096 | A | * | 3/1966 | Sloan | 84/272 |
| 3,499,361 | A | * | 3/1970 | Harleman | 84/402 |
| 3,521,518 | A | * | 7/1970 | Cohen | 84/402 |
| 3,610,085 | A | * | 10/1971 | Wilson | 84/402 |
| 3,869,954 | A | * | 3/1975 | Ito | 84/291 |
| 3,961,553 | A | * | 6/1976 | Schorr | 84/408 |
| 4,213,368 | A | * | 7/1980 | Cox | 84/269 |
| 4,317,402 | A | * | 3/1982 | McPherson, Sr. | 84/291 |
| 4,467,692 | A | * | 8/1984 | Egan | 84/291 |
| 5,025,695 | A | * | 6/1991 | Viel | 84/293 |
| 5,207,769 | A | * | 5/1993 | Malta | 84/404 |
| 5,272,951 | A | * | 12/1993 | Cohen | 84/402 |
| 5,918,299 | A | * | 6/1999 | Yui | 84/291 |
| 5,920,020 | A | * | 7/1999 | Korupp | 84/410 |
| 5,922,979 | A | * | 7/1999 | Yui | 84/291 |
| 5,949,006 | A | * | 9/1999 | Hechler | 84/291 |
| 5,952,591 | A | * | 9/1999 | Thurman | 84/267 |
| 6,057,499 | A | * | 5/2000 | Basmadjian | 84/411 R |

(Continued)

OTHER PUBLICATIONS

Meinl (four hole covers) Turbo Cabasa ,image and description, item on sale at the Drum Works, http://www.thedrumworks.com/Meinl_Turbo_Cabasa.html, viewed Mar. 28, 2008.*

Meinl (five hole covers) Turbo Cabasa ,image and description, http://meinlpercussion.com/products/meinl_percussion/cabasas/turbo_cabasa.html, viewed Mar. 28, 2008.*

(Continued)

*Primary Examiner*—Walter Benson
*Assistant Examiner*—Robert W Horn
(74) *Attorney, Agent, or Firm*—Browdy and Neimark, P.L.L.C.

(57) ABSTRACT

In a musical instrument of the cabasa type having a substantially cylindrical hollow main body with a cover plate, and base plate, and a handle connected to the base plate, wherein between the cover plate and base plate along the outer surface of the main body beaded-string-like sounding bodies are arranged extending in the circumferential direction, which, when the main body is rhythmically shaken, by their movement against each other and relative to the surface of the main body, generate a tone, provision is made that the cover plate and/or the base plate are provided with openings.

3 Claims, 2 Drawing Sheets

U.S. PATENT DOCUMENTS

| | | | | |
|---|---|---|---|---|
| 6,211,448 | B1 * | 4/2001 | Shigenaga et al. | 84/411 R |
| 6,459,024 | B1 * | 10/2002 | Baker | 84/291 |
| 6,805,608 | B2 * | 10/2004 | Forbes et al. | 446/397 |
| 6,955,582 | B1 * | 10/2005 | Forbes et al. | 446/397 |
| 7,169,994 | B1 * | 1/2007 | Payerl | 84/402 |
| 2003/0061929 | A1 * | 4/2003 | Dye et al. | 84/411 R |
| 2007/0144330 | A1 * | 6/2007 | Gasul, III | 84/291 |
| 2008/0202315 | A1 * | 8/2008 | McMichen | 84/402 |

OTHER PUBLICATIONS

Tiara, Steve, "How to Make a Shekere," © 1996-2000, last revision Mar. 13, 2000, http://www.drums.org/djembefaq/v8b.htm, viewed Mar. 28, 2008.*

Daria Marmaluk-Hajioannou, "Making Musical Instruments at Home," © 2002-2007, image of Shekere with top opening, making a shekere. http://songsforteaching.com/articles/makingmusicalinstrumentsathome.htm, viewed Mar. 28, 2008.*

* cited by examiner

MUSICAL INSTRUMENT

BACKGROUND OF THE INVENTION

1. Field of the Invention

The invention relates to a musical instrument of the cabasa type having a substantially cylindrical hollow main body with a cover plate, and a base plate, and a handle connected to the base plate, wherein between the cover plate and base plate along the outer surface of the main body beaded-string-like sounding bodies are arranged extending in the circumferential direction, which, when the main body is rhythmically shaken, by their movement against each other and relative to the surface of the main body, generate a tone. Musical instruments of this type are referred to as a cabasa.

2. Background Art

In the case of previously known musical instruments of this type, it was assumed until now that the tone generation and radiation takes place primarily on the surface of the main body in combination with the sounding bodies that are arranged there.

SUMMARY OF THE INVENTION

The invention is based on the object of improving a musical instrument of the generic type with respect to its sound qualities and creating novel sound impressions.

The object is met according to the invention in such a way that the cover plate and/or the base plate are provided with openings.

According to the invention, it has now surprisingly been found that as a result of providing such openings, the sound is able to travel from the interior of the main body to the outside, and in the process a completely different and novel tone color is created than by those sound components that are generated on the surface of the main body and radiated from there.

In a further improvement of the invention, provision may be made for the openings to be formed as circular holes.

Preferably four such holes are distributed about the circumference of the cover plate or base plate, respectively.

The diameter of the holes is advantageously dimensioned such that it is approximately two thirds of the radial distance between the outer surface of the handle and outer surface of the main body.

The invention will be explained in more detail below based on a preferred example embodiment in conjunction with the drawing.

DESCRIPTION OF THE PREFERRED EMBODIMENT

Figure 1:
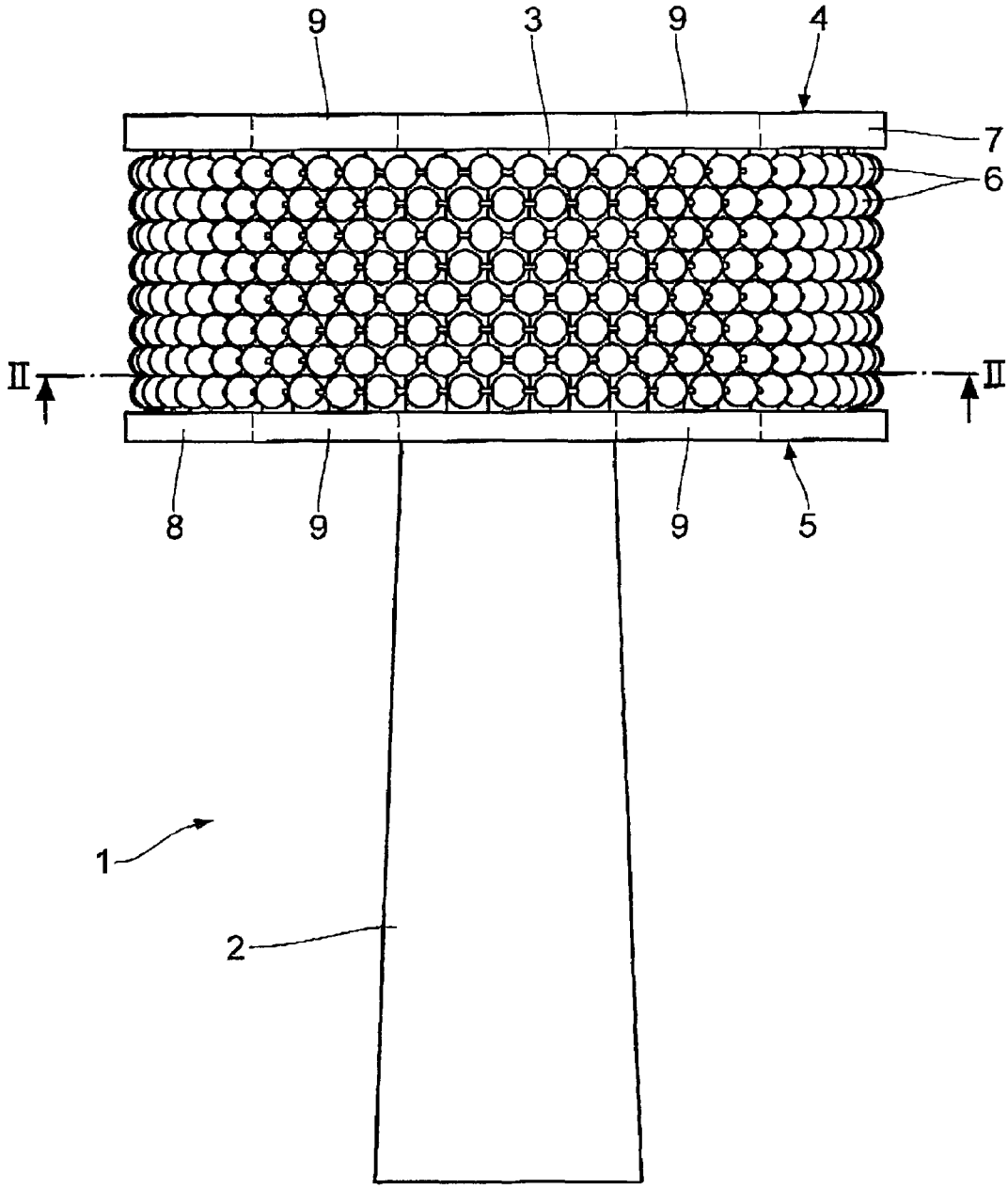
FIG. 1 shows a side view of an inventive musical instrument.
Figure 2:
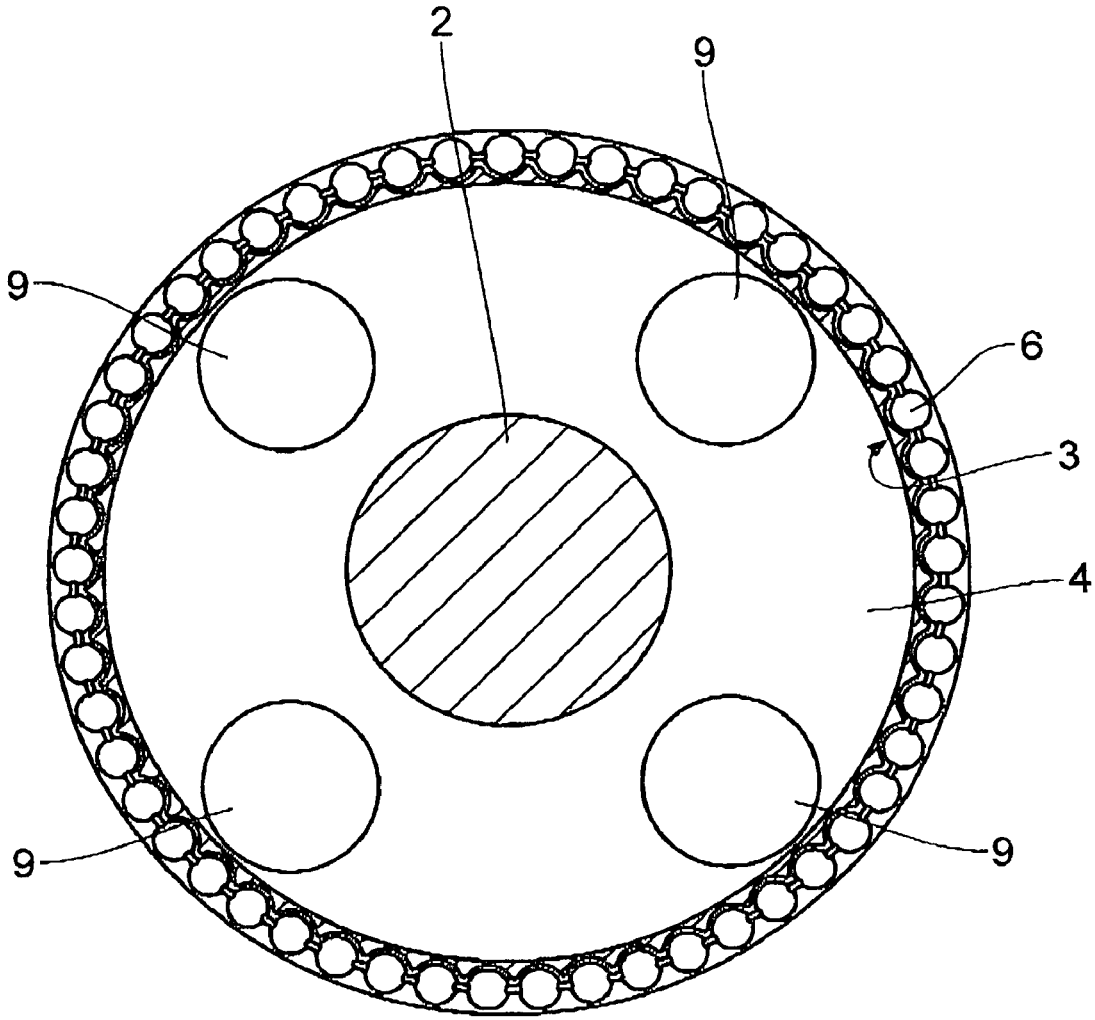
FIG. 2 shows a section along the line II-II in FIG. 1.

An inventive musical instrument 1 shown in the drawing comprises a handle 2 and a cylindrical main body 3 having a cover plate 4 projecting beyond its periphery and a base plate 5.

Strung onto the outer surface of the main body 3 in the style of a string of beads are round sounding bodies 6, beyond which the outer edge 7 of the cover plate 4 and the outer edge 8 of the base plate 5 project to a small degree in the radial direction.

The cover plate 4 and base plate 5 each are provided with four circular holes 9 that permit the sound that is generated inside the main body 3 to be radiated, which superposes with the sound that is generated on the surface of that main body 3 and that is radiated directly.

What is claimed is:

1. A musical instrument of the cabasa type having a substantially cylindrical hollow main body (3) with a cover plate (4), and a base plate (5), and a handle (2) connected to the base plate (5), wherein between the cover plate (4) and base plate (5) along the outer surface of the main body (3) beaded-string-like sounding bodies (6) are arranged extending in the circumferential direction, which, when the main body (3) is rhythmically shaken, by their movement against each other and relative to the surface of the main body (3), generate a tone, wherein both the cover plate (4) and the base plate (5) are provided with openings (9), which are formed as round or circular holes.

2. A musical instrument according to claim 1, wherein four openings (9) are distributed about the circumference of at least one of the cover plate (4) and base plate (5).

3. A musical instrument according to claim 1, wherein the diameter of the round holes (9) is approximately two thirds of the radial distance between the outer surface of the handle (2) and the periphery of the main body (3).

* * * * *